US007394200B2

(12) United States Patent
Selezneva et al.

(10) Patent No.: US 7,394,200 B2
(45) Date of Patent: Jul. 1, 2008

(54) CERAMIC AUTOMOTIVE HIGH INTENSITY DISCHARGE LAMP

(75) Inventors: Svetlana Selezneva, Schenectady, NY (US); Sairam Sundaram, Guilderland, NY (US); Mohamed Rahmane, Clifton Park, NY (US); Sergiy Zalyubovskiy, Niskayuna, NY (US); Gary R. Allen, Chesterland, OH (US); Viktor K. Varga, Solon, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/289,932

(22) Filed: Nov. 30, 2005

(65) Prior Publication Data

US 2007/0120492 A1 May 31, 2007

(51) Int. Cl.
*H01J 61/30* (2006.01)
*H01J 17/16* (2006.01)

(52) U.S. Cl. ..... 313/634; 313/573; 313/637; 313/620; 313/621

(58) Field of Classification Search ..... 313/634, 313/638, 150, 163, 637, 546, 580, 595
See application file for complete search history.

(56) References Cited

U.S. PATENT DOCUMENTS 4,795,943 A * 1/1989 Antonis et al. ..... 313/620
4,970,431 A * 11/1990 Vegter et al. ..... 313/634
5,923,127 A * 7/1999 Keijser et al. ..... 315/224
6,084,351 A * 7/2000 Kai et al. ..... 313/634
6,307,321 B1 * 10/2001 Honda et al. ..... 313/634
6,404,129 B1 * 6/2002 Hendricx et al. ..... 313/620
6,586,881 B1 * 7/2003 Miyazawa et al. ..... 313/634
6,791,267 B2 9/2004 Niimi
7,045,960 B2 * 5/2006 Gunter ..... 313/570
2002/0057058 A1 * 5/2002 Honda et al. ..... 313/578
2004/0056600 A1 * 3/2004 Lapatovich et al. ..... 313/634
2004/0119413 A1 6/2004 Kebbede et al.
2004/0124776 A1 7/2004 Iorio
2004/0140769 A1 * 7/2004 Horiuchi et al. ..... 313/623
2006/0158092 A1 * 7/2006 Ning ..... 313/491
2006/0164017 A1 * 7/2006 Rintamaki et al. ..... 313/640

FOREIGN PATENT DOCUMENTS

JP 2001076677 A * 3/2001

* cited by examiner

*Primary Examiner*—Sikha Roy
(74) *Attorney, Agent, or Firm*—Paul J. DiConza

(57) ABSTRACT

A high intensity discharge lamp, the lamp including a light emitting vessel having a wall made of ceramic material that defines an inner space with a first end portion having a respective first opening formed therein and a second end portion having a respective second opening formed therein, two discharge electrodes, with a first electrode extending therethrough the first opening of the first end portion of the vessel and a second electrode extending therethrough the second opening of the second end portion of the vessel, together forming a gap between ends of the discharge electrodes positioned within the vessel, wherein the light emitting vessel defines an inner space characterized by an inner diameter ranging from and including 1 millimeters to 3 millimeters and an inner length between and including 5 millimeters to 10 millimeters, wherein the wall of the vessel has a thickness ranging between and including 0.3 millimeters to 0.8 millimeters, wherein each tip of the electrodes within the vessel have a shank diameter ranging between and including 0.2 millimeters to 0.55 millimeters, and wherein the gap between the ends of the electrodes positioned within the vessel is smaller than 4 millimeters.

10 Claims, 3 Drawing Sheets

CERAMIC AUTOMOTIVE HIGH INTENSITY DISCHARGE LAMP

FIELD OF INVENTION

This invention relates generally to the field of lighting systems and, more specifically, to high-intensity discharge lamps.

BACKGROUND OF THE INVENTION

Within the automotive industry, High Intensity Discharge (HID) lamps are beginning to replace conventional incandescent halogen lights as lights for headlamps. In an HID lamp, light is generated by means of an electric discharge that takes place between two metal electrodes enclosed within a quartz envelope sealed at both ends. The main advantages of HID lamps are high lumen output, better efficacy and longer life. The HID headlamps available currently are Quartz Metal Halide lamps that are also used for general lighting.

The discharge medium in Quartz Metal Halide lamps consist of a mixture of xenon, mercury, sodium iodide (NaI) and/or scandium iodide ($ScI_3$), wherein the surrounding envelope, or arc-tube, is made of quartz with tungsten electrodes protruding within the envelope. In operation, the lamp size is kept small enough for optical coupling purposes. Further, the lamps are required to meet the automotive industry standard of starting fast by delivering at least eighty percent of their steady state lumens no later than four seconds from the point at which they are turned on. The small lamp size and fast start requirements result in higher wall thermal loading, which in turn poses some limits on the quartz envelope material, and significant thermal stresses in the arc-tube, especially near the electrode roots. These limitations result in shortening the lamp life and also decreasing reliability of the lamp.

Because of improved reliability and performance, quartz in HID lamps is being replaced with ceramic material, such as polycrystalline alumina (PCA) and yttrium aluminum garnet (YAG). Ceramic arc-tubes can withstand higher temperatures and the cold spot temperature in ceramic lamps can be driven to a high enough value to evaporate the metal halide dose and produce enough vapor pressure for both the light emitting elements and the buffer gas. However, changing to ceramic material requires a change in the design of HID lamps to best optimize the thermal and structural integrity of the lamps.

BRIEF DESCRIPTION OF THE INVENTION

This invention is directed towards a high intensity discharge lamp that provides for a sufficiently large cold spot temperature while at the same time sufficiently small hot spot temperature and also an electrode tip temperature high enough to provide electron emission and low stress within the lamp. Towards this end, a lamp comprising a light emitting vessel having a wall made of ceramic material that defines an inner space with a first end portion having a respective first opening formed therein and a second end portion having a respective second opening formed therein is disclosed. Two discharge electrodes, with a first electrode extending therethrough the first opening of the first end portion of the vessel and a second electrode extending therethrough the second opening of the second end portion of the vessel, together forming a gap between ends of the discharge electrodes positioned within the vessel is also disclosed.

The light emitting vessel defines an inner space characterized by an inner diameter ranging from and including 1 millimeters to 3 millimeters and an inner length between and including 5 millimeters to 10 millimeters. The wall of the vessel has a thickness ranging between and including 0.3 millimeters to 0.8 millimeters. Each tip of the electrodes within the vessel has a shank diameter ranging between and including 0.2 millimeters to 0.55 millimeters. The gap between the ends of the electrodes positioned within the vessel is smaller than 4 millimeters.

In another exemplary embodiment a high intensity discharge lamp providing for a sufficiently large cold spot temperature while at the same time sufficiently small hot spot temperature and also an electrode tip temperature high enough to provide electron emission and low stress within the lamp is disclosed. The lamp includes a light emitting vessel having a wall made of ceramic material that defines an inner space with a first end portion having a respective first opening formed therein and a second end portion having a respective second opening formed therein. Two discharge electrodes, with a first electrode extending therethrough the first opening of the first end portion of the vessel and a second electrode extending therethrough the second opening of the second end portion of the vessel, together forming a gap between ends of the discharge electrodes positioned within the vessel is also disclosed.

Further, a reflective coating proximate an outer surface of the vessel near the end portions of the vessel is provided. The light emitting vessel defines an inner space characterized by an inner diameter ranging from and including 1.5 millimeters to 2.1 millimeters and an inner length between and including 6 millimeters to 10 millimeters. The wall of the vessel has a thickness ranging between and including 0.4 millimeters to 0.65 millimeters. Each tip of the electrodes within the vessel has a shank diameter ranging between and including 0.3 millimeters to 0.5 millimeters. The gap between the ends of the electrodes positioned within the vessel ranging between and including 4 millimeters to 5 millimeters.

In another exemplary embodiment a high intensity discharge lamp comprises a light emitting vessel having a wall made of ceramic material that defines an inner space with a first end portion having a respective first opening formed therein and a second end portion having a respective second opening formed therein. It further comprises two discharge electrodes, with a first electrode extending therethrough the first opening of the first end portion of the vessel and a second electrode extending therethrough the second opening of the second end portion of the vessel, together forming a gap between ends of the discharge electrodes positioned within the vessel.

The light emitting vessel defines an inner space characterized by an inner diameter ranging from and including 1 millimeters to 1.7 millimeters and an inner length between and including 5 millimeters to 8 millimeters. The wall of the vessel has a thickness ranging between and including 0.3 millimeters to 0.6 millimeters. Each tip of the electrodes within the vessel has a shank diameter ranging between and including 0.25 millimeters to 0.5 millimeters. Furthermore, the gap between the ends of the electrodes positioned within the vessel is smaller than 3 millimeters.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

With reference to the figures, exemplary embodiments of the invention will now be described. As presented below, dimensional ranges are provided for different aspects of the present invention. Though not explicitly stated, the ranges include the values defining the ranges. Thus, a particular dimension may possess the actual range limits discussed below. Additionally, these range limits are approximations only. Towards this end, since the limits are provided with two significant figures, a value outside of these limits that may round up to the next significant two-digit figure should also be considered included within the range limits provided. Also presented herein are actual computation data. Though computational data is presented herein, it should by no means be considered limiting as to the scope of the present invention. Those skilled in the art will readily recognize that depending on experimental conditions that may not be exactly identical case-to-case, the results provided may not always repeat exactly.

Additionally, though dimensions disclosed herein are presented as though the dimensions appear uniform for a particular element, the dimensions in an element may vary depending on location. For example, an arc-tube, including the arc-tube legs and arc-tube body may have has a uniform wall thickness in one exemplary embodiment. Whereas in another exemplary embodiment, the arc-tube body may have a different wall thickness than the arc-tube legs.

Furthermore, though ceramic HID automotive lamps are discussed throughout, this invention is applicable to other ceramic HID lamps as well. Thus, the present invention is applicable to other ceramic HID lamps used with transportation vehicles, such as in airplane landing gear, as well as generally used ceramic HID lamps. Additionally, since a ceramic envelope material is used instead of quartz, the HID lamps disclosed herein operate at higher temperature than quartz lamps. This in turn can provide for a more efficient mercury-free lamp.

In designing a ceramic HID lamp, consideration should be given to circumferential and axial tensile stresses that may develop on the outside part of an arc-tube during operation of the lamp. These stresses may result from significant temperature gradients within the arc-tube that result from heat flux from the discharge to the walls. In view of this issue, one design goal described herein is to have a lamp with decreased temperature gradients within the arc-tube as well as along the arc-tube length. Another design goal is to limit stresses and temperature increases on the inside of the arc-tube. Limitation of the stresses and temperature will reduce a possibility of creep deformation within the arc-tube. Towards this end, since the temperature of an HID lamp is controlled at least in large part by the arc-tube and electrode dimensions, the dimensions of these elements can be concurrently optimized relative to one another.

Figure 1:
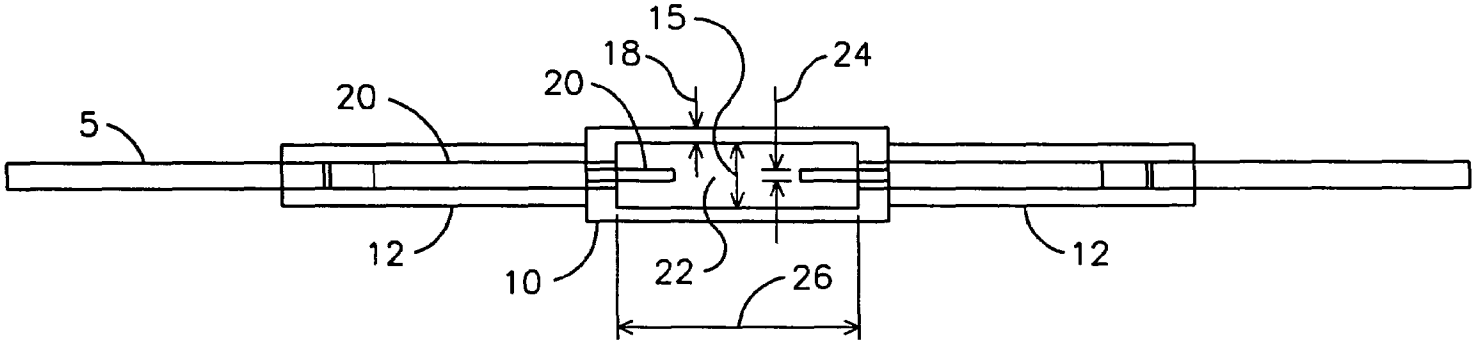
FIG. 1 is an exemplary embodiment of a schematic of a HID lamp of the present invention without a coating.

FIG. 1 is an exemplary embodiment of a schematic of a HID lamp of the present invention without a coating. As illustrated, the ceramic HID lamp 5 has a straight cylindrical arc-tube body 10, also referred to as an envelope or vessel. The central part of the arc tube is preferentially cylindrical geometry but may also be elliptical, spherical, or intermediate shapes. Co-sintered cylindrical ceramic legs 12 are located at opposite ends of the arc-tube body 10. In another exemplary embodiment a single piece ceramic arc-tube may be used wherein the legs 12 are part of this single piece ceramic arc-tube. Within the HID lamp 5, a metal electrode 20, typically made from tungsten, is inserted and sealed inside each leg 12 and extends into the arc-tube body 10.

The input power for HID automotive lamps is generally between 20 W and 50 W, preferably between 25 W and 45 W, and most preferably 35 W. In one embodiment, the input power for HID automotive lamps incorporating teachings of the present invention is about 35 W. However, the input power can be varied depending upon the desired lamp life and light output. For example, by reducing the input power, the lamp life can be extended albeit with a decrease in light output. Conversely, by increasing the input power, the light output can be increased albeit with a decrease in lamp life.

The arc-tube body 10 has an inner diameter 15 less than or equal to 2.0 mm, preferably less than 1.7 mm, and a wall thickness 18 between 0.3 mm and 0.6 mm. The reduction of inner diameter 15 is beneficial for the reduction of both axial and hoop stresses developed in the lamp. This benefit is evident from the table below, Table 1, and further illustrated in FIGS. 4 & 5, which illustrate exemplary computational fluid dynamic and structural analysis results for axial stress and hoop stress when the present invention is utilized.

TABLE 1

Effect of Arc-Tube Thermal Gradients on Maximal Steady State Stresses (in Mpa)

| | $T_{34}$ | $T_{32}$ | $T_{33'}$ | $S_{34}$ | $S_{32}$ | $S_{33'}$ | Sp | Axial Stress |
|---|---|---|---|---|---|---|---|---|
| id = 2.4 mm | 6.7 | 139.7 | 194.5 | 10 | 21 | 29 | 15 | 75 |
| id = 1.6 mm | 7.3 | 36.6 | 208.1 | 11 | 5 | 30 | 10 | 56 |
| Unit | K | K | K | Mpa | Mpa | Mpa | Mpa | Mpa |

Figure 2:
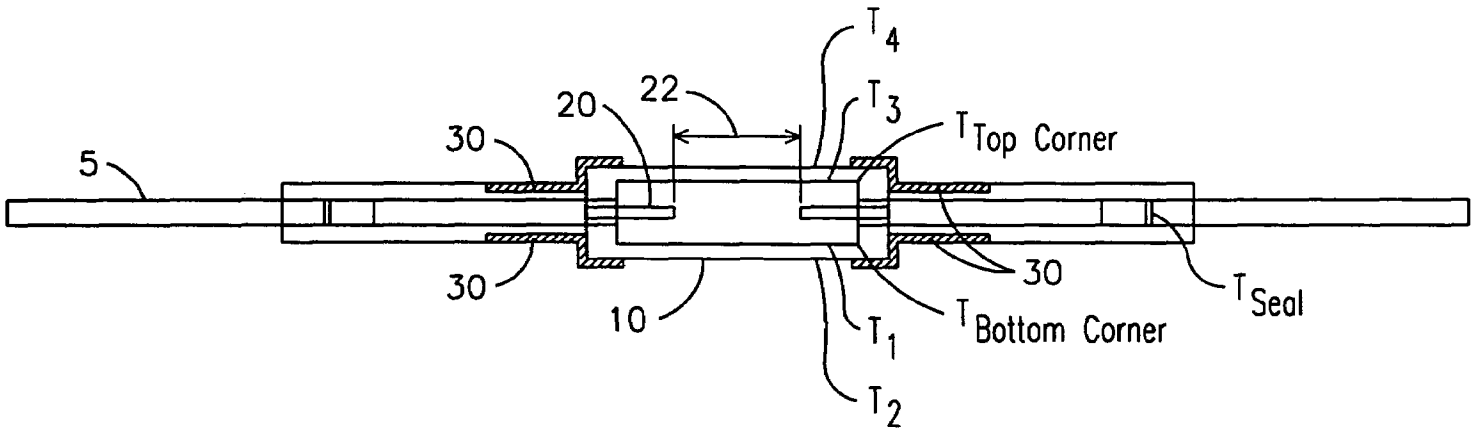
FIG. 2 is an exemplary embodiment of a schematic of a HID lamp of present invention with a coating.
Figure 4:
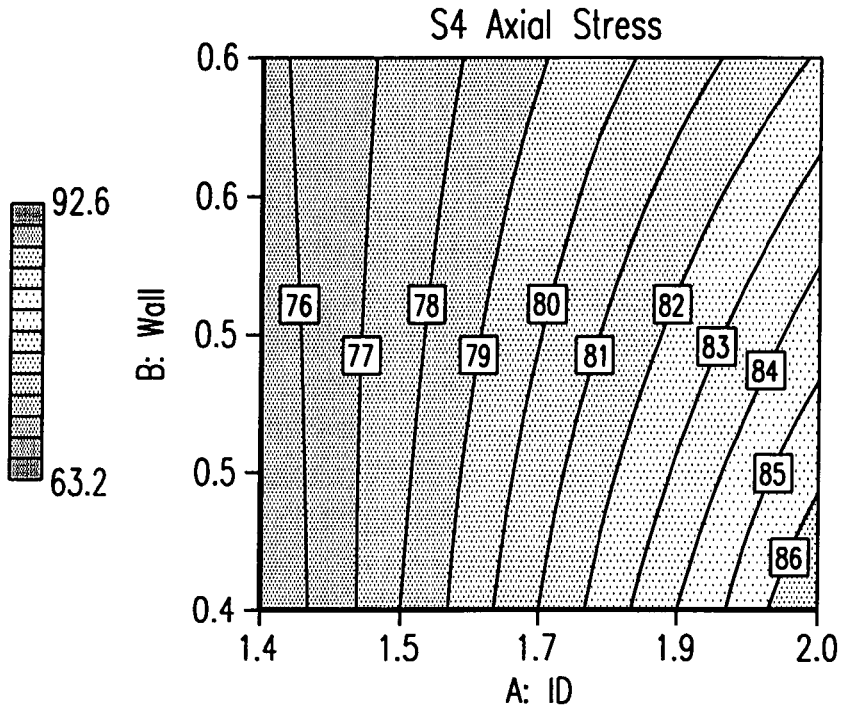
FIG. 4 is an exemplary representation of relative effects of arc tube wall thickness and its diameter on maximal steady state axial stresses generated in the arc tube.
Figure 5:
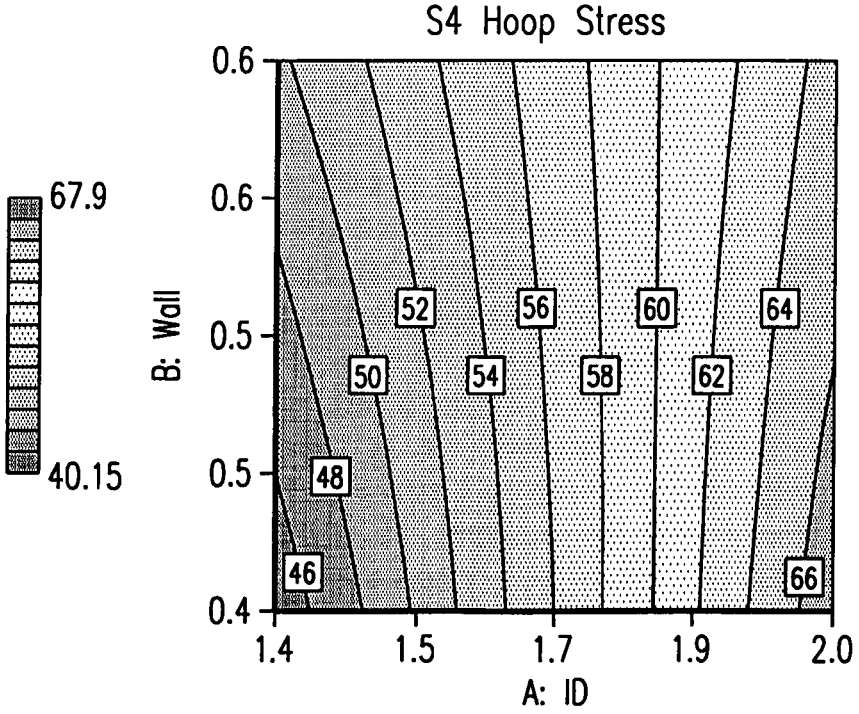
FIG. 5 is an exemplary representation of relative effects of arc tube wall thickness and its diameter on maximal steady state hoop stresses generated in the arc tube.

From detailed computational fluid dynamic (CFD) and structural analyses, it is found that, both hoop and axial stresses in the arc-tube at the location of the maximum tensile stresses at the outside top center of the arc-tube (at location T4 illustrated in FIG. 2 where T stands for Temperature) are related to the key temperature differences and pressure by the following relations:

$$\sigma_4 = S_{34} + S_{32} + S_{33'} + S_p$$

where $S_{34}$, $S_{32}$, $S_{33}'$ and Sp are monotonic functions of $T_{34}$, $T_{32}$, $T_{33'}$ and pressure respectively. The exact functional forms for both hoop and axial stresses are obtained from the results of CFD and structural analyses. In these expressions, $T_{34}$=T3−T4, $T_{32}$=T3−T2, $T_{33'}$=T3−Ttop-corner (Ttp). Approximate locations of T1, T2, T3, T4, Ttop_corner and Tbottom_corner on the arc-tube body 10 are illustrated in FIG. 2. For example, for an id of 2.4 mm and 1.6 mm the corresponding values of $S_{34}$, $S_{32}$, $S_{33'}$ and Sp contributing to the axial stress are given in Table 1. It is seen from Table 1, that the reduction of the inner diameter id 15 down to 1.6 mm reduces substantially $T_{32}$ and therefore the axial stresses; and in general the reductions of the $T_{32}$ and $T_{33}$, are helpful for stress reduction. Through analysis, and as illustrated in FIGS. 4 and 5, it has also been shown that mostly the inner diameter and much less the bulb wall thickness affects both the axial and the hoop stresses in the lamp. In particular, the reduction of the inner diameter from 2 mm down to 1.4 mm helps decrease the maximal axial stress by more than 10% and the maximal hoop stress by about 30%.

If the ceramic legs 12 are cosintered, their insertion length into the arc-tube body is between 0.5 mm and 3 mm. The gap 22 between the electrode tips is smaller than 5 mm, such as between 2.8 mm and 3 mm. With respect to automobiles, the current electrode gap is standardized at 4 mm to 4.5 mm. However, it has been advantageously recognized that reducing the electrode tip gap 22 in association with the other lamp and electrode dimensions disclosed herein provides for an improved HID automotive lamp 5.

Figure 3:
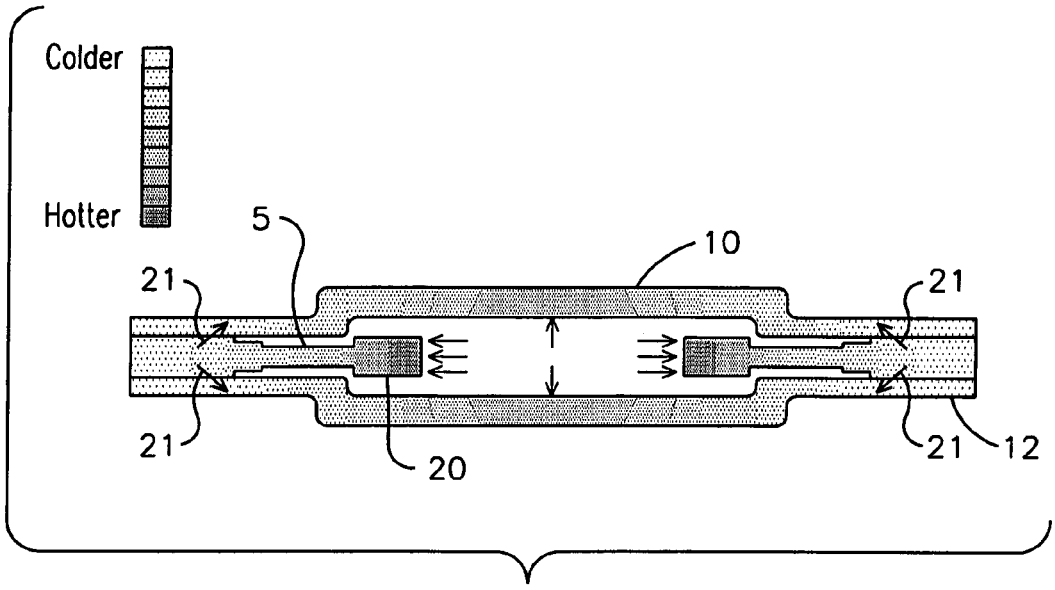
FIG. 3 is an exemplary embodiment of a schematic arc-tube heating partition between the arc discharge and the conduction through the electrodes.

FIG. 3 is an exemplary embodiment of a schematic arc-tube heating partition between the arc discharge and the conduction through the electrodes. As illustrated, as a ceramic bulb envelope is heated both directly from the arc discharge and by the heat conducted through the electrode, the electrode dimensions depend on the arc tube dimensions. The arrows 21 in the legs 12 further illustrate that heat is conducted from a location of the electrode within the leg 12 to the arc-tube 5. For instance, a larger electrode shank diameter 24 is used in the lamps with larger inner diameter and it is preferably less than 0.5 mm but larger than 0.2 mm.

Moreover, vehicle forward lighting applications demand brighter lamps with high luminance in order to make their optical system as small as possible, and thereby reduce the system cost and enhance its overall performance (luminance). The luminance is defined as the ratio of the amount of lamp lumens to the "etendue", E (optical extent) of the application (L=lumens/E). It is known that the etendue is proportional to the product of the arc gap and arc diameter. For this reason, typically the shorter the arc gap (arc length), the higher the lamp luminance. Similarly, for the wall stabilized arcs, the smaller the bulb inner diameter, the larger is the lamp luminance.

Exemplary design rules have been developed. These rules are established to provide for a HID lamp to have a sufficiently large cold spot temperature that is equivalent to having high vapor pressure of the metal halide gases. These design rules and provide for sufficiently small hot spot temperature, and large enough electrode tip temperature. Thus these designs rules allow for electron thermoionic emission. In particular, it has been determined that the arc-tube body 10 wall thickness 18 depends on the inner diameter 15. Accordingly, the wall thickness 18 should be increased if the inner diameter 15 is decreased. For example, in accordance with one embodiment of the invention, a wall thickness larger than 0.3 mm and smaller than 0.45 mm is suitable for an arc-tube 10 having an inner diameter of 1.6 mm. However, if the arc-tube 10 has an inner diameter of 1.1 mm, the wall thickness should be smaller than 0.6 mm, such as 0.48 mm. Similarly, the minimal electrode shank diameter 24 should be increased if the inner diameter 15 is increased. Thus, the most preferable design space is an inner diameter 15 between 1.1 mm and 1.7 mm, a wall thickness 18 between 0.3 mm and 0.6 mm, a shank diameter 24 between 0.28 mm and 0.52 mm, and an arc-tube inner bulb length (ibl) 26 between 6 mm and 10 mm. All dimensional measurement ranges are inclusive and are intended to be satisfied at the same time in order to provide an efficient HID lamp 5.

FIG. 2 is an exemplary embodiment of a schematic of the HID lamp of the present invention with a coating. The coating 30 has several functions. First, by reducing the amount of thermal radiation coming from the arc-tube, it controls the thermals of the legs where the metal halide dose typically resides, thus helping vaporize more light-emitting dose. Second, the coating reduces the axial arc tube temperature gradients. This benefit is further illustrated in Table 2 in view of the difference T3−Ttop_corner.

TABLE 2

Temperatures in K for the bulb dimensions: id = 1.4 mm, wall = 0.44 mm, ibl = 6 mm

| Description | T1 | T2 | T3 | T4 | Maximum Seal Temp. | Maximum Electrode Temp. | Cold Spot Temp. | Bottom Corner Temp. | Top Corner Temp. |
|---|---|---|---|---|---|---|---|---|---|
| No coating | 1391 | 1402 | 1446 | 1431 | 716 | 2413 | 980 | 1217 | 1228 |
| With a Coating | 1442 | 1453 | 1499 | 1478 | 719 | 2426 | 1065 | 1308 | 1318 |

Reducing the axial arc tube temperature gradients is also beneficial for the thermal stress reduction, further illustrated in Table 1, and therefore longer life of the lamp. Third, an opaque coating covering the ends of the arc tube body results in eliminating the undesirable portion of the light that causes glare in the projected beam, such as when directed at a ground covering such as a paved road.

In one exemplary embodiment, a coating is made of high temperature opaque oxide (e.g. Zirconia or Alumina). In another exemplary embodiment, a thin (e.g., thickness less than 200 micro-meter) reflective coating 30, such as any high temperature metal with suitable corrosion properties is applied on the outer surface of the arc-tube covering. For example, Platinum (Pt) is applied approximately 0.5 mm on each end of the arc-tube body 10 and approximately 1-3 mm on each leg surface 12, if legs are provided.

The design rules of the present invention for when a coating 30 is used include having the inner diameter preferably less than 2.3 mm. The design rules further dictate that the arc-tube wall thickness 18 is a function of the inner diameter 15 and the arc-tube wall thickness 18 should be increased if the inner diameter 15 is decreased. For example, a 0.4 mm wall thickness 18 is suitable for the arc-tube body 10 having an inner diameter 15 of 2.25 mm. However, for an arc-tube body 10 with an inner diameter 15 of 1.6 mm, the wall thickness 18 is larger than 0.69 mm. As another example, for an arc-tube body 10 with an inner diameter 15 of 1.8 mm, the wall thickness 18 is larger than 0.54 mm.

The design rules further dictate that the electrode 20 shank diameter 24 should be between 0.25 mm and 0.5 mm if the inner diameter 15 of the arc-tube body 10 is in the range of 1.1 mm and 2 mm. Table 3 depicts the combined effect of the electrode shank diameter, the bulb inner diameter and the wall thickness on bulb thermals.

TABLE 3

Effect of the id, wall thickness and shank diameter (in mm) on the bulb key temperatures (in K), ibl = 6 mm, arc gap = 3 mm

| id | wall | Shank_d | T1 | T2 | T3 | T4 | $T_{bottom_corner}$ | $T_{top_corner}$ |
|---|---|---|---|---|---|---|---|---|
| 1.1 | 0.3 | 0.25 | 1617 | 1629 | 1646 | 1633 | 1287 | 1291 |
| 2 | 0.3 | 0.25 | 1213 | 1215 | 1384 | 1376 | 1127 | 1170 |
| 1.1 | 0.6 | 0.25 | 1332 | 1356 | 1371 | 1344 | 1131 | 1134 |
| 2 | 0.6 | 0.25 | 1058 | 1061 | 1176 | 1158 | 1003 | 1032 |
| 1.1 | 0.3 | 0.5 | 1640 | 1652 | 1669 | 1655 | 1313 | 1315 |
| 2 | 0.3 | 0.5 | 1227 | 1229 | 1411 | 1403 | 1151 | 1193 |
| 1.1 | 0.6 | 0.5 | 1361 | 1387 | 1401 | 1373 | 1163 | 1165 |
| 2 | 0.6 | 0.5 | 1081 | 1084 | 1208 | 1189 | 1032 | 1061 |

As a large portion of heating energy, approximately 23% of the input power reaches the arc tube 10 through the electrodes 20 the smaller the inner diameter 15 of arc-tube body 10 is, the smaller the electrode 20 shank diameter 24 needs to be as well. For example, for an inner diameter 15 of 1.75 mm, the electrode 20 shank diameter 24 is smaller than 0.35 mm. Whereas, for the arc-tube body 10 inner diameter 15 of 1.85 mm, the electrode 20 shank diameter 24 is smaller than 0.45 mm. The preferred design specifications are for the inner diameter 15 to be between 1.5 mm and 2.1 mm, the wall thickness 18 to be between 0.4 mm and 0.65 mm, the shank diameter 24 to be between 0.3 mm and 0.5 mm, and the ibl 26 to be between 6 mm and 10 mm.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A high intensity discharge lamp comprising:

a) a light emitting vessel having a wall made of ceramic material that defines an inner space with a first end portion having a respective first opening formed therein and a second end portion having a respective second opening formed therein;

b) two discharge electrodes, with a first electrode extending with clearance through the first opening of the first end portion of the vessel and a second electrode extending with clearance through the second opening of the second end portion of the vessel, together forming a gap between ends of the discharge electrodes positioned within the vessel;

c) first and second tubular legs, each leg comprising a proximal end sealed around a respective one of the openings;

d) wherein the light emitting vessel defines an inner space characterized by an inner diameter ranging from and including 1 millimeters to 3 millimeters and an inner length between and including 5 millimeters to 10 millimeters;

e) wherein the wall of the vessel has a thickness ranging between and including 0.3 millimeters to 0.8 millimeters;

f) wherein each tip of the electrodes within the vessel have a shank diameter ranging between and including 0.2 millimeters to 0.55 millimeters;

g) wherein a distance of the gap between the ends of the electrodes positioned within the vessel is less than 4 millimeters; and h) wherein the wall thickness is determined by an inverse relationship with the inner diameter of the vessel.

2. The lamp of claim 1 wherein the vessel wall thickness is in a range of 0.3 mm to 0.6 mm, and the vessel inner diameter is in a respectively related range of 1.7 mm to 1.1 mm.

3. The lamp of claim 1 wherein the shank diameter is in a range of 0.28 mm to 0.52 mm, and the vessel inner diameter is in a respectively related range of 1.1 mm to 1.7 mm.

4. The lamp of claim 1 further comprising a reflective coating on an outer portion of each end portion of the light emitting vessel and covering a proximal portion of each leg.

5. The lamp of claim 1, wherein each electrode extends with radial clearance through an inner passage of the respective leg, and each electrode is sealed against a distal end of the respective inner passage.

6. The lamp of claim 1, wherein the electrode shank diameter is determined by a direct relationship with the inner diameter of the vessel.

7. A high intensity discharge lamp comprising:

a) a light emitting vessel having a wall made of ceramic material that defines an inner space with a first end portion having a respective first opening formed therein and a second end portion having a respective second opening formed therein;

b) two discharge electrodes, with a first electrode extending with clearance through the first opening of the first end portion of the vessel and a second electrode extending with clearance through the second opening of the second end portion of the vessel, together forming a gap between ends of the discharge electrodes positioned within the vessel;

c) first and second tubular legs, each leg comprising a proximal end sealed around a respective one of the openings, each electrode extending with radial clearance through an inner passage of the respective leg, and each electrode sealed against a distal end of the respective inner passage;

d) a reflective coating on an outer portion of each end portion of the light emitting vessel;

e) wherein the light emitting vessel defines an inner space characterized by an inner diameter ranging from and including 1.5 millimeters to 2.1 millimeters and an inner length between and including 6 millimeters to 10 millimeters;

f) wherein the wall of the vessel has a thickness ranging between and including 0.4 millimeters to 0.65 millimeters;

g) wherein each tip of the electrodes within the vessel has a shank diameter ranging between and including 0.3 millimeters to 0.5 millimeters;

h) wherein a distance of the gap between the ends of the electrodes positioned within the vessel ranging between and including 4 millimeters to 5 millimeters;

i) wherein the electrode shank diameter is determined by a direct relationship with the inner diameter of the vessel.

8. The lamp of claim 7, wherein the wall thickness is determined by an inverse relationship with the inner diameter of the vessel.

9. A high intensity discharge lamp, the lamp comprising:

a) a light emitting vessel having a wall made of ceramic material that defines an inner space with a first end portion having a respective first opening formed therein and a second end portion having a respective second opening formed therein;

b) two discharge electrodes, with a first electrode extending with radial clearance through the first opening of the first end portion of the vessel and a second electrode extending with radial clearance through the second opening of the second end portion of the vessel, together forming a gap between ends of the discharge electrodes positioned within the vessel;

c) wherein the light emitting vessel defines an inner space characterized by an inner diameter ranging from and including 1 millimeters to 1.7 millimeters and an inner length between and including 5 millimeters to 8 millimeters;

d) wherein the wall of the vessel has a thickness ranging between and including 0.3 millimeters to 0.6 millimeters;

e) wherein each tip of the electrodes within the vessel has a shank diameter ranging between and including 0.25 millimeters to 0.5 millimeters;

f) wherein a distance of the gap between the ends of the electrodes positioned within the vessel is smaller than 3 millimeters; and g) wherein the wall thickness is determined by an inverse relationship with the inner diameter of the vessel, and the electrode shank diameter is determined by a direct relationship with the inner diameter of the vessel.

10. The lamp of claim 9 further comprising a reflective coating on an outer portion of each end portion of the light emitting vessel.

* * * * *